United States Patent [19]

Beebe

[11] 4,283,808

[45] Aug. 18, 1981

[54] GRIPPING DEVICE FOR TOOTH BRUSHES

[76] Inventor: Lee M. Beebe, 2089 Garden La., Costa Mesa, Calif. 92627

[21] Appl. No.: 76,248

[22] Filed: Sep. 17, 1979

[51] Int. Cl.[3] ..... A46B 17/02

[52] U.S. Cl. ..... 15/145; 15/167 R; 16/114 R; D4/25

[58] Field of Search ..... 15/143 R, 145, 146, 15/167 R, 167 A; 29/80; 30/340–342; 145/61 A, 61 D; 16/110 R, 114 R; D4/10, 25; 74/551.9

[56] References Cited

U.S. PATENT DOCUMENTS

| | | | |
|---|---|---|---|
| 1,645,965 | 10/1927 | Neumerkel | 15/167 R X |
| 1,978,532 | 10/1934 | Gurnee | 30/342 |
| 2,378,641 | 6/1945 | Kisky | 15/167 R |
| 2,520,808 | 8/1950 | Miller | 16/116 R |
| 3,438,413 | 4/1969 | Borah | 145/61 A |
| 3,915,782 | 10/1975 | Davis | 16/116 R X |

FOREIGN PATENT DOCUMENTS

| | | | |
|---|---|---|---|
| 379150 | 8/1932 | United Kingdom | 15/167 R |

*Primary Examiner*—Edward L. Roberts
*Attorney, Agent, or Firm*—Francis X. LoJacono

[57] ABSTRACT

A gripping device for tooth brushes adapted to be positioned over the handle of the tooth brush, the gripping device comprising an elongated body member formed from a plastic foam material and having a cross-sectional diameter so that the tooth brush can be readily gripped by the user thereof. The body includes a centrally disposed longitudinal slot adapted to receive the tooth-brush handle in a releasably secured manner, whereby the brush can be removed for replacement.

1 Claim, 6 Drawing Figures

GRIPPING DEVICE FOR TOOTH BRUSHES

BACKGROUND OF THE INVENTION

1. Field of the Invention

This invention relates to tooth brushes, and more particularly to a removable gripping handle member so as to better fit the hand of the individual user for brush control while brushing his teeth.

2. Description of the Prior Art

The general design of a tooth brush is well known in the art. However, very little has been done in the way of providing an improvement in the handle to allow one to have better control in manipulating the brush during the cleaning of his teeth. That is, since each individual has a different hand size, it would be very advantageous to have a proper-size handle for a tooth brush so as to provide a more firm and positive grip.

To the applicant's knowledge, there is at present no such device that allows one to effectively change the size of the handle to accommodate the user.

SUMMARY OF THE INVENTION

The present invention comprises a gripping device designed particularly for use with existing tooth brushes and has an elongated body member formed from a pliable plastic material of any suitable foam type, the body member being provided with a central longitudinal slot having an open end to receive the handle portion of the tooth brush. The gripping device can either be permanently affixed to the handle or removably positioned thereon, whereby various tooth brushes can be interchanged therewith.

An alternative embodiment additionally provides a thin membrane or film that covers the foam material, thus making the gripping member impervious to water.

OBJECTS AND ADVANTAGES OF THE INVENTION

The present invention has for an important object a provision wherein any well known type of tooth brush can be fitted with a gripping-handle device that is soft and pliable, to allow the user thereof better hold and control of the movement of the brush while cleaning his teeth.

It is another object of the invention to provide a gripping device for tooth brushes wherein the device comprises an elongated body member that includes a central longitudinal slot, whereby the handle of the tooth brush can be readily received within the gripping body member.

It is still another object of the invention to provide a device of this character that is pliable enough to conform to the grip of one's hand, yet firm enough to provide a positive control in the manipulation of the brush while brushing his teeth.

It is a further object of the invention to provide a removable and replaceable handle grip for tooth brushes that is relatively simple and rugged in construction, and inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Referring more particularly to the accompanying drawing, there is shown a typical tooth brush, indicated generally at 10, having the well-known brush or bristles 12 affixed at one end thereof, and a handle 14 extending outwardly therefrom. The common form of the brush handle 14 is generally an elongated member having a relatively small, defined, cross-sectional configuration which is sometimes difficult to grip properly while brushing one's teeth.

Figure 1:
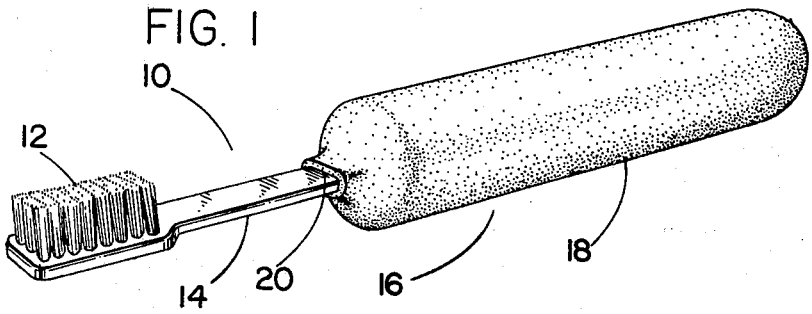
FIG. 1 is a perspective view of a typical tooth brush having the present invention mounted thereto.
Figure 2:
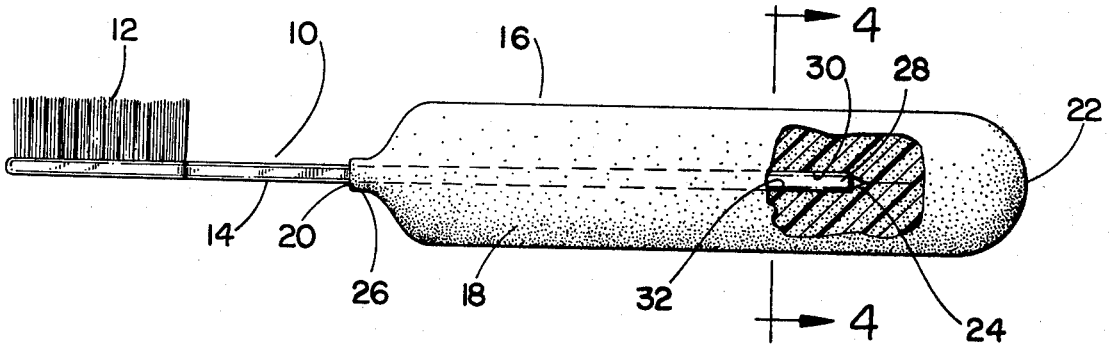
FIG. 2 is a side-elevational view of the device with a portion thereof broken away.
Figure 3:
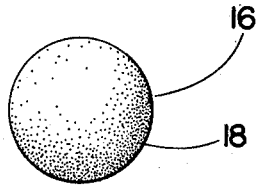
FIG. 3 is an end-elevational view of the gripping device.
Figure 4:
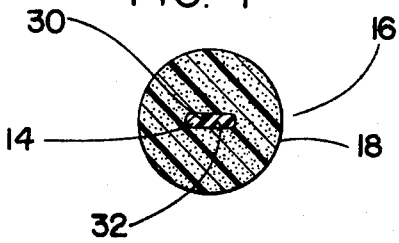
FIG. 4 is a cross-sectional view taken substantially along line 4—4 of FIG. 2.
Figure 6:
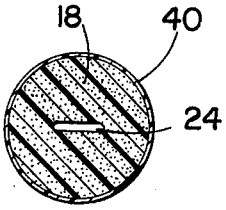
FIG. 6 is a cross-sectional view of the gripping device having a thin protective cover formed thereover.

FIGS. 1 and 2 illustrate the present invention as being a gripping device, designated generally at 16, mounted to the tooth-brush handle 14. As seen therein, it is not necessary for the gripping device to completely cover the brush handle 14; and it can be well understood that the gripping device may be longitudinally positioned along handle 14 in accordance to one's liking.

Accordingly, the gripping device 16 comprises an elongated body member 18 having preferably a cylindrical cross-sectional configuration. It should be understood that various materials can be used to form body 18; but the preferred material is a pliable plastic, such as a suitable-type foam that is relatively firm, yet pliable to conform to the grip of one's hand.

The gripping body 18 is provided with an open end 20 and a closed rear end 22, the open end 20 being defined by a centrally disposed slot 24 that extends longitudinally within the body and terminates adjacent the closed rear end 22. In addition, in the embodiment as shown in FIGS. 1 and 2, body 18 includes a protruding lip portion 26. When handle 14 of the tooth brush is inserted into slot 24, handle end 28 forces the pliable material to part in order to receive the length of handle 14. Thus, after handle 14 is positioned in body 18, the resiliency of the material causes the opposing slot surfaces 30 and 32 to engage handle 14, thereby holding or securing body 18 to the tooth brush 10. Hence, it can be understood that when the tooth brush becomes worn and needs to be replaced, one simply pulls the gripping body 18 free from the tooth brush and replaces the brush with a new one.

However, if desired, a bonding agent or glue can be employed to affix the gripping body in a permanent manner to handle 14.

Figure 5:
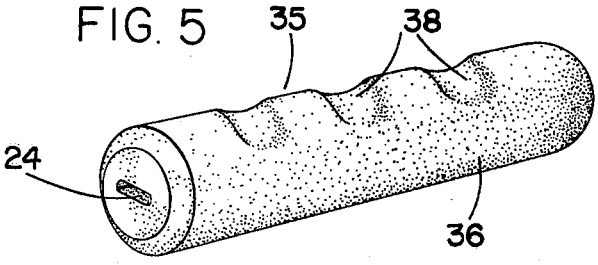
FIG. 5 is an alternative embodiment of the present invention.

Referring now to FIG. 5, there is shown a gripping device 35 wherein the body 36 includes a plurality of formed grooves 38. These grooves can be provided with various configurations and arrangements, so that they can be adapted to allow the user's fingers to fit the groove forms. Thus, the material employed in this embodiment need not be pliable, as indicated in the preferred form thereof.

It is further contemplated that either of the heretofore mentioned gripping bodies can be provided with a cover or film 40 of very thin material, to encapsulate the body, thereby making it impervious to water. This cover will also allow the gripping device to be produced with different colors or indicia.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A removable gripping device in combination with a tooth brush, comprising:

an elongated body having an open end and a closed end, said body being formed from a pliable foam plastic material;

a slot centrally positioned longitudinally from said open end to a point adjacent the closed rear end, and adapted to receive the handle portion of said tooth brush, said slot having opposing surfaces to frictionally engage said tooth-brush handle, whereby said body is removably mounted to said tooth-brush handle, said body being provided with a substantially cylindrical cross sectional configuration having a sufficient diameter to be grasped in one's hand;

said open end of said body formed to include a protruding lip portion; and said body including a cover member formed thereon to encapsulate said body, said cover member being impervious to water.

* * * * *